US007600450B2

(12) United States Patent
Montgomery et al.

(10) Patent No.: US 7,600,450 B2
(45) Date of Patent: Oct. 13, 2009

(54) CURVATURE CONFORMABLE GRIPPING DIES

(75) Inventors: Timothy I. Montgomery, Corona, CA (US); Matthew David Becker, Alta Loma, CA (US); Guy L. McClung, III, Spring, TX (US)

(73) Assignee: National Oilwell Varco LP, Houston, TX (US)

( * ) Notice: Subject to any disclaimer, the term of this patent is extended or adjusted under 35 U.S.C. 154(b) by 0 days.

(21) Appl. No.: 12/075,794

(22) Filed: Mar. 13, 2008

(65) Prior Publication Data

US 2009/0229424 A1 Sep. 17, 2009

(51) Int. Cl.
*B25B 13/50* (2006.01)

(52) U.S. Cl. ..... 81/57.33; 81/57.15; 81/186; 175/423

(58) Field of Classification Search ..... 81/57.33, 81/185.1, 186, 57.15, 57.17; 294/902; 166/380; 269/268; 175/423
See application file for complete search history.

(56) References Cited

U.S. PATENT DOCUMENTS

| | | | | |
|---|---|---|---|---|
| 2,184,231 | A | 12/1939 | Allen | |
| 2,287,432 | A | 6/1942 | Kinzbach | |
| 2,589,159 | A | 3/1952 | Stone | |
| 3,023,651 | A | 3/1962 | Wallace | |
| 3,052,943 | A | 9/1962 | Jones | 24/263 |
| 3,215,010 | A * | 11/1965 | Montgomery et al. | 81/186 |
| 3,531,836 | A * | 10/1970 | Crickmer | 175/423 |
| 3,765,721 | A * | 10/1973 | Watkin | 297/452.32 |
| 3,778,094 | A | 12/1973 | Grolet et al. | 294/1.1 |
| 4,511,168 | A | 4/1985 | Haynes | 294/102.2 |
| 5,221,099 | A * | 6/1993 | Jansch | 279/151 |
| 5,390,682 | A * | 2/1995 | Iams | 5/632 |
| 5,451,084 | A * | 9/1995 | Jansch | 294/1.1 |
| 5,452,728 | A * | 9/1995 | Iams | 5/630 |
| 5,484,222 | A * | 1/1996 | Schulze-Beckinghausen | 403/307 |
| 5,485,770 | A * | 1/1996 | Popelak | 81/423 |
| 5,522,104 | A * | 6/1996 | Little | 5/632 |
| 5,704,261 | A | 1/1998 | Strauch et al. | 81/467 |
| 5,848,647 | A | 12/1998 | Webre et al. | 166/379 |
| 5,971,086 | A | 10/1999 | Bee et al. | 175/423 |
| 6,089,338 | A | 7/2000 | Bouligny, Jr. | 175/423 |
| 6,299,248 | B1 * | 10/2001 | Gennaro et al. | 297/230.13 |
| 6,332,377 | B1 | 12/2001 | Pietras et al. | 81/57.33 |
| 6,378,399 | B1 | 4/2002 | Bangert | 81/57.15 |
| 6,732,822 | B2 * | 5/2004 | Slack et al. | 175/423 |
| 6,755,097 | B2 | 6/2004 | Bangert | 81/57.5 |
| 7,036,397 | B2 | 5/2006 | Bangert | 81/57.5 |
| 7,204,173 | B2 | 4/2007 | Buck | 81/57.18 |
| 7,231,984 | B2 | 6/2007 | Jaensch | 166/380 |
| 7,445,050 | B2 * | 11/2008 | Kuttel et al. | 166/380 |

* cited by examiner

*Primary Examiner*—David B Thomas
(74) *Attorney, Agent, or Firm*—Guy McClung

(57) ABSTRACT

A gripper is disclosed for gripping a tubular, e.g. to facilitate rotation of the tubular, the gripper including a body, the body having conformable material having an initial body shape, and the conformable material able to change the initial body shape upon contacting a tubular with the body, the tubular having a tubular shape, the conformable material able to conform to the tubular shape of the tubular to facilitate gripping of the tubular with the gripper. This abstract is provided to comply with the rules requiring an abstract which will allow a searcher or other reader to quickly ascertain the subject matter of the technical disclosure and is submitted with the understanding that it will not be used to interpret or limit the scope or meaning of the claims, 37 C.F.R. 1.72(b).

8 Claims, 11 Drawing Sheets

FIG. 3
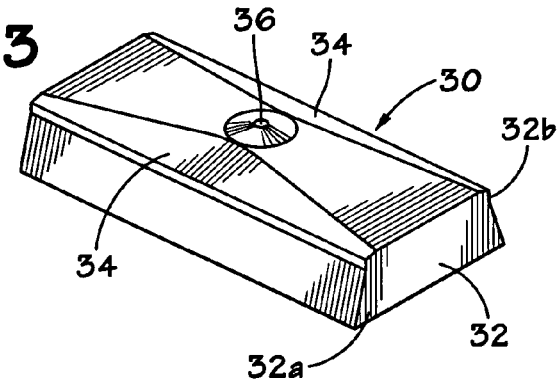
FIG. 3A
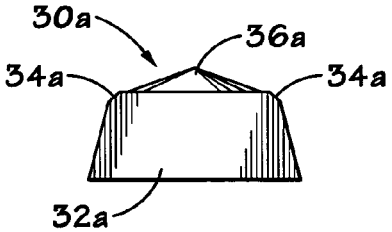
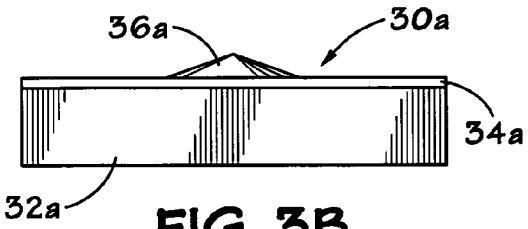
FIG. 3B
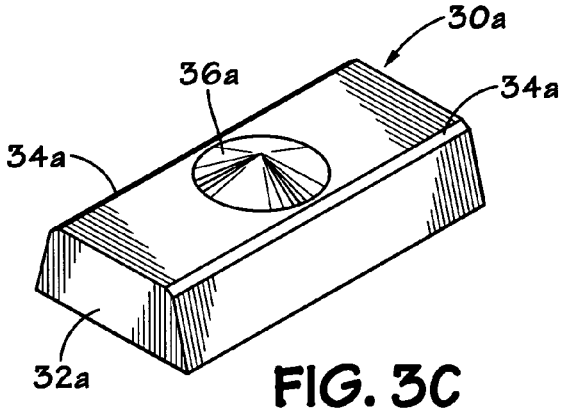
FIG. 3C
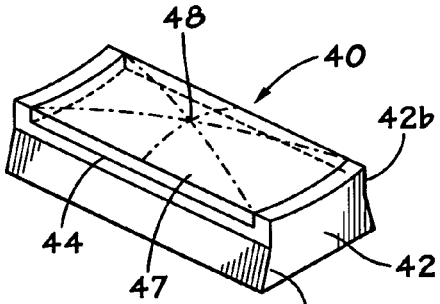
FIG. 4A
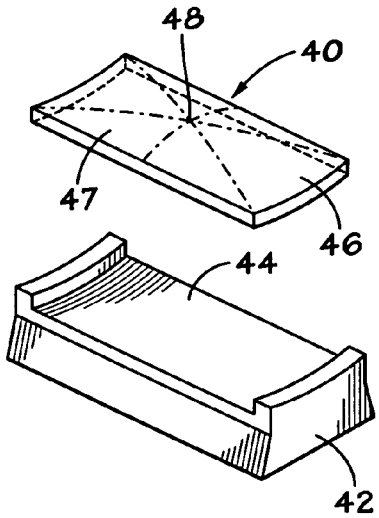
FIG. 4B
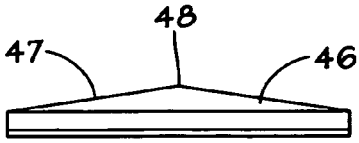
FIG. 4C
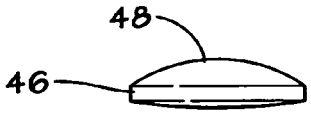
FIG. 4D FIG. 5A
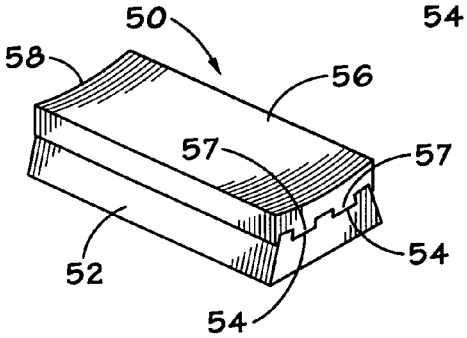
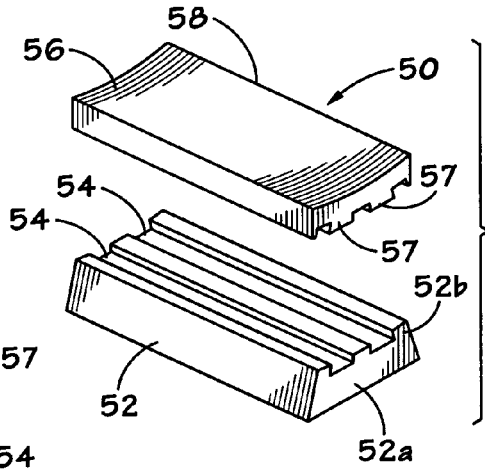
FIG. 5B
FIG. 5C
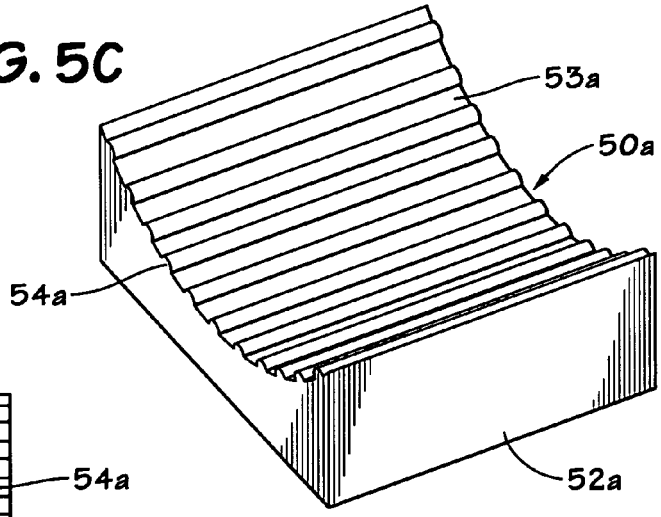
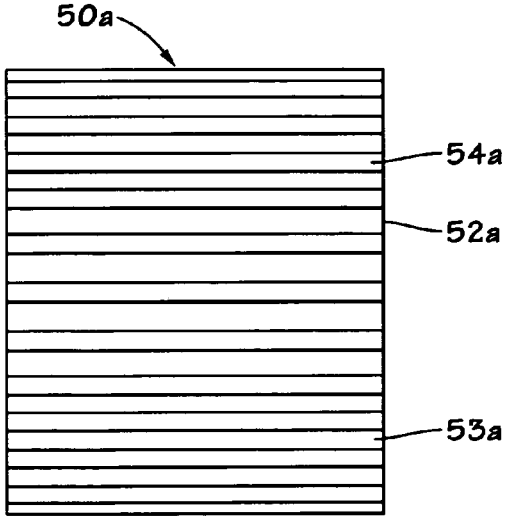
FIG. 5D
FIG. 5E
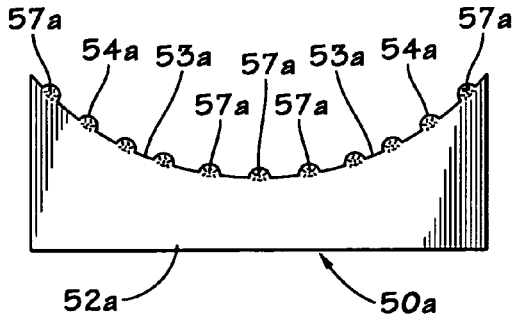

FIG. 6A
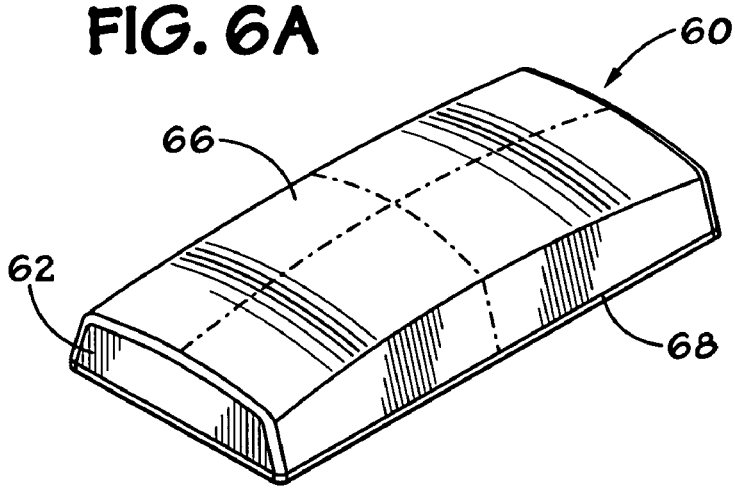
FIG. 6B
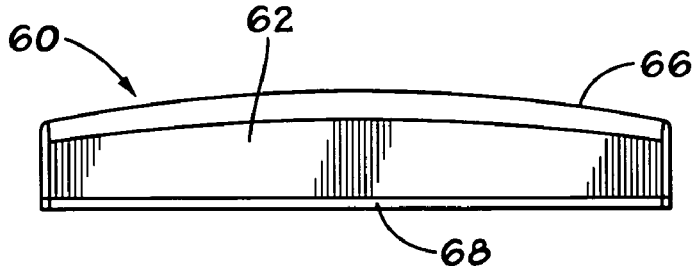
FIG. 6C
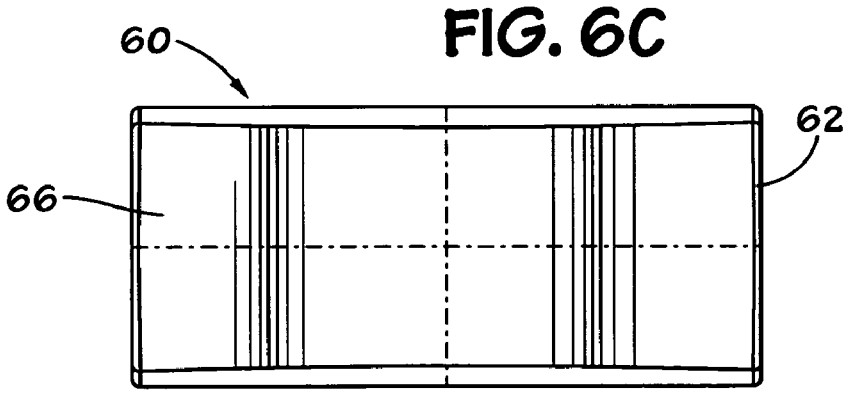
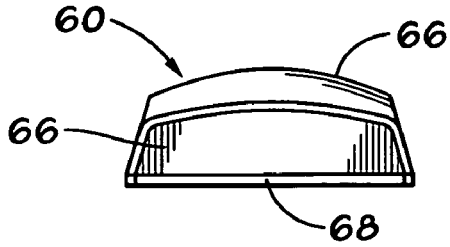
FIG. 6D

FIG. 7A
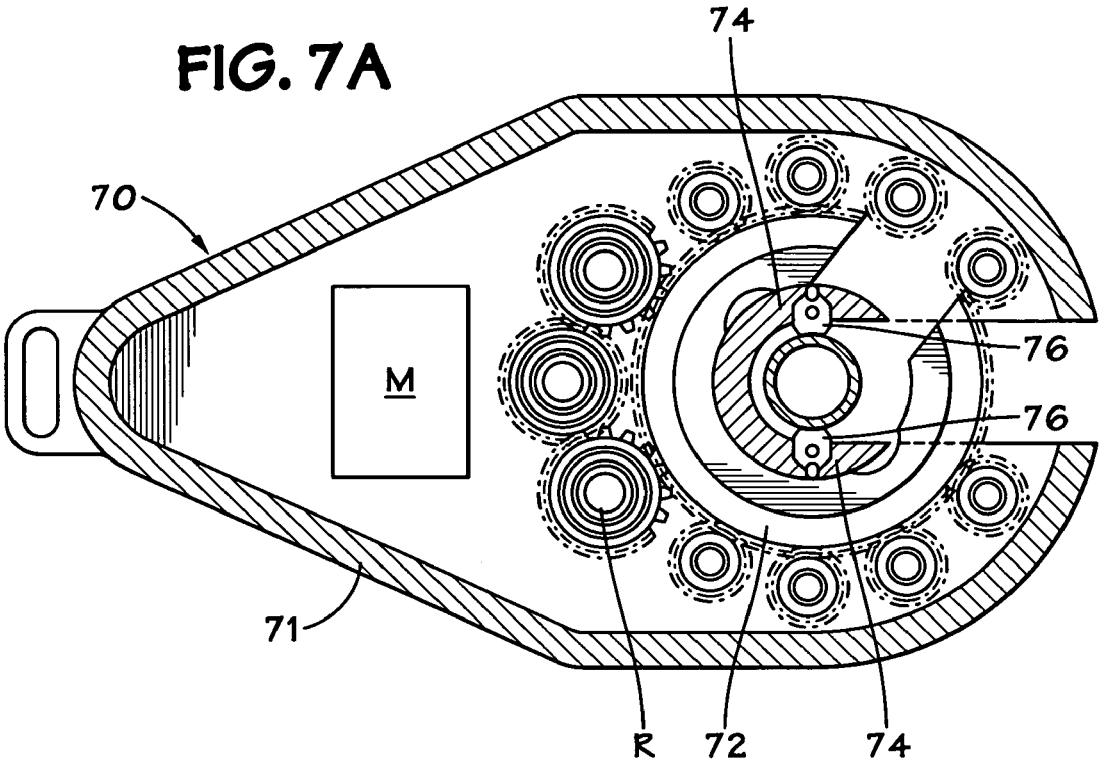
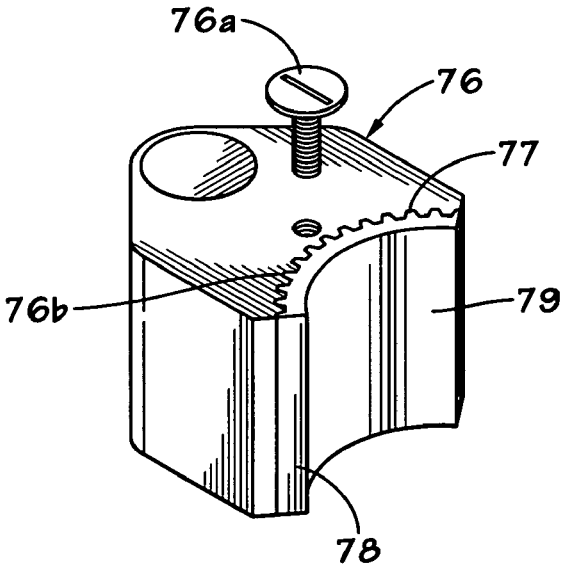
FIG. 7B
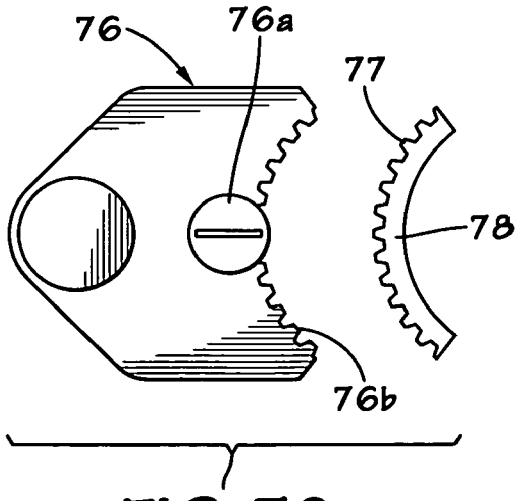
FIG. 7C

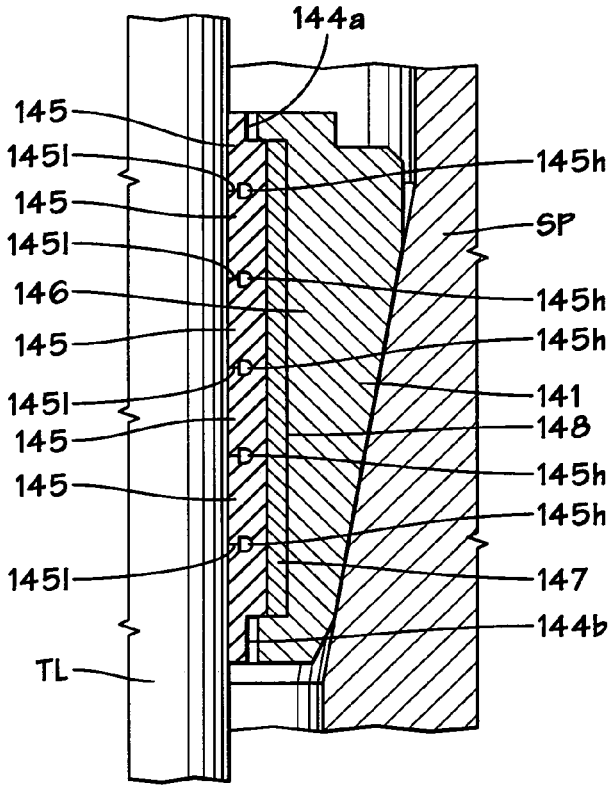
FIG. 14
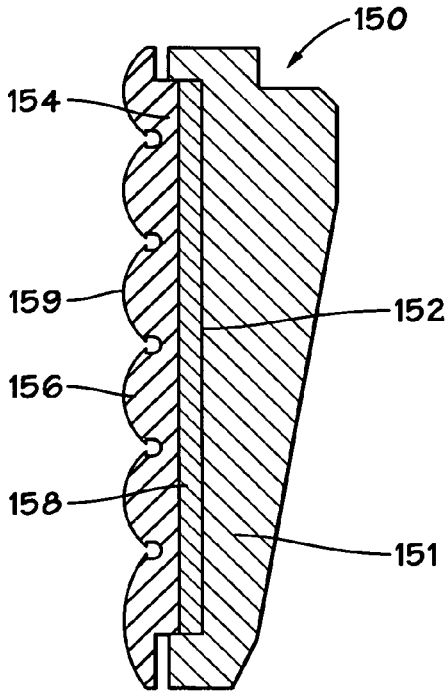
FIG. 15
FIG. 16
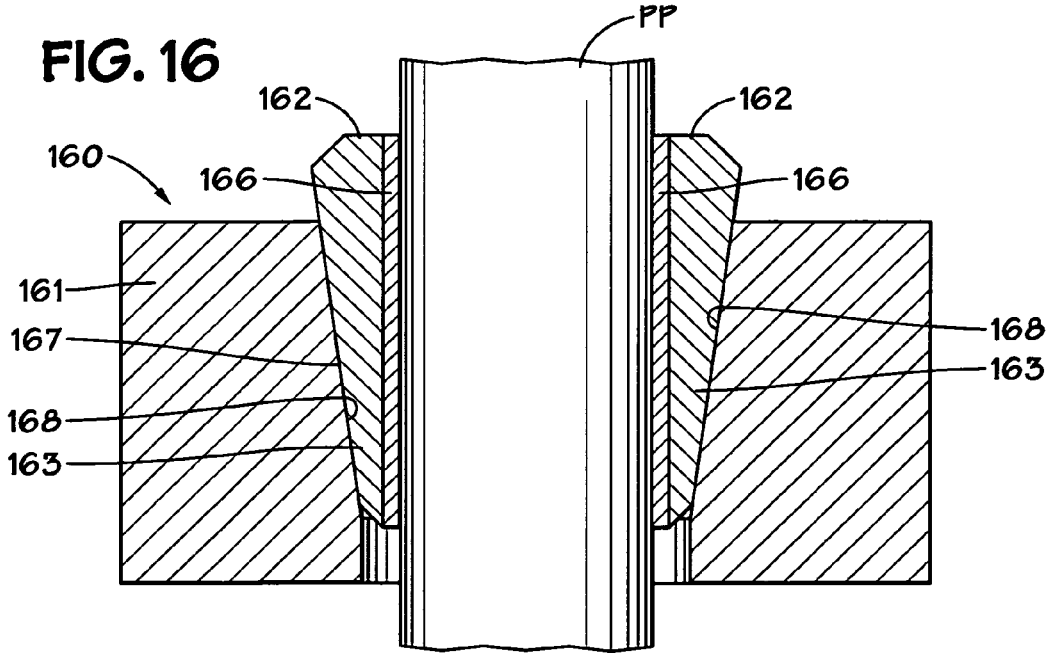

CURVATURE CONFORMABLE GRIPPING DIES

BACKGROUND OF THE INVENTION

1. Field of the Invention

The present invention is directed to the gripping of tubulars in the oil and gas well drilling industry, such as oil well piping and casing which can include rotating tubulars, holding tubulars fixed against rotation, and holding tubulars in a position, e.g. in a vertical position. In particular aspects, this invention relates to securely gripping an oil field tubular without significantly marking or damaging the tubular.

2. Description of Related Art

A variety of oil field apparatuses and devices are used to grip tubular members, in some cases while torque is being applied to a tubular member. For example, a variety of apparatuses use grippers (e.g. dies, gripping elements, and gripping members) to grip tubulars (such as casing, tubing, and pipe) including slips, elevators, spiders, clamps, tongs, backups and "chrome tools" used for gripping and/or rotating tubular members.

Power tongs in general have jaws which grip a tubular member. In several instances these jaws have a die member which is a sub-component of the jaw that contacts the tubular member. These dies can have ridges or teeth that contact and can cut into a tubular. In certain instances, there are five to eight teeth per linear inch formed across the gripping surface of a die which can bite into a tubular and prevent slippage between the tubular and the jaws when torque loads are applied to the tongs or the tubular.

Other apparatuses grip a tubular and hold the tubular in position, e.g. in position against vertical movement. The tubular can be part of a tubing, casing or drill string formed with a series of tubulars suspended above and/or in a wellbore. These apparatuses include, e.g., conventional slips, elevators, spiders, and safety clamps. Some slips and safety clamps use the weight of the tubular and/or string, and, in some cases, an external preload, to force gripping surfaces into contact with the tubular. In some cases, a gripping member of a slip has a gripping surface or gripping die on one face and an inclined plane on an opposite face. A slip holder, bowl or similar structure has a second and supplementary inclined surface positioned around the tubular with sufficient space between the tubular and slip bowl for the gripping member to be partially inserted between the slip bowl and tubular. Movement of the gripping member's inclined surface along the slip bowl's inclined surface moves the gripping surface to engage the tubular. In certain instances, the die or gripping surface of known slips is similar to that of tong jaw dies and the gripping surface has a series of steel teeth which bite into a tubular.

The teeth of known dies and gripping surfaces can leave deep indentations or gouges in the surface of the tubular which can adversely affect the structural integrity of the tubular member by causing a weak point in the metal which can render the tubular unsuitable for further use or can lead to premature failure of the tubular at a future date.

Die teeth made from carbon steel can introduce iron onto the surface of certain tubulars, e.g. a corrosion resistant alloy (CRA) tubular. Iron in a bite mark can act as a catalyst, causing a premature, rapid corrosion failure in the CRA tubular. This is also true for certain CWOR, completion and workover riser system tubulars.

Since many CRA materials such as stainless steel are work hardened materials, the malleability of the material can decrease after the material is mechanically stressed. Bite marks or indentations in stainless steel tubulars can produce localized "cold working" in the tubular so that points at which the marks are made are then less malleable than the other parts, creating weak points. Teeth in a uniform pattern can inflict bite marks which create a major stress riser which is more detrimental than a few individual random marks of similar depth, creating more damaging internal stresses in the tubular than a non-uniform pattern of bite marks.

In certain known systems, dies with smooth metal (e.g. aluminum) surfaces are used to engage a tubular. Such dies rely on a frictional grip and often employ significantly greater clamping forces than dies with teeth which can increase the risk that clamping forces damage a tubular. Also such aluminum surfaces can have an insufficiently high coefficient of friction to prevent slippage between the dies and the tubular at high torque loads or high vertical loads. To deal with this slippage, dies with fabric or screen in combination with an aluminum surface have been used. A carbide screen is placed between the tubular and the dies before the dies close upon the tubular. With the carbide screen, a substantially higher coefficient of friction can be developed between the dies and the tubular, but the screen is re-positioned between the tubular and die surface each time the dies grip and then release a tubular. In certain systems, instead of a separate screen, grit-faced (e.g. carbide or diamond) dies are used.

Many known dies have a fixed curvature which corresponds to the outer curvature of a tubular to be gripped or to a portion of this outer curvature. Depending on the outer curvature of the tubular to be gripped, these dies can have an uncertain gripping point(s) or grip center. A die whose gripping surface contacts a large portion of a relatively large tubular may contact only a minimal portion of a smaller tubular. It is also possible that minimal contact is achieved with much larger tubulars.

The prior art discloses a variety of tubular grippers; for example, and not by way of limitation, the following U.S. patent application and U.S. patents present exemplary systems and components thereof: U.S. Pat. Nos. 4,649,777; 5,291,808; 4,576,067; 7,036,397; 6,378,399; 7,204,173; 5,221,099; 7,231,984; 5,451,084; and 6,332,377—these applications and these patents all incorporated fully herein for all purposes.

The present inventors have recognized the need for a non-marking gripping die and methods of its use which provides a certain grip area or grip center. The present inventors have recognized the need for such a gripping die which does not damage a gripped tubular. The present inventors have recognized the need for a gripping die whose grip area is adjustable in use. The present inventors have recognized the need for a gripping die which can be used without manually placing a carbide cloth, screen or fabric adjacent the die.

BRIEF SUMMARY OF THE INVENTION

The present invention, in certain aspects, discloses a gripping die for gripping oilfield tubulars which has a gripper which contacts a tubular to be gripped and is made of conformable material that then conforms to the tubular's curvature in proportion to the grip force applied to the die. Thus, in certain aspects, the die matches the tubular's outer curvature through deflection and/or compression set rather than being initially manufactured with a fixed die curvature corresponding to the curvature of a particular tubular.

In certain aspects, such a gripper or die element has a shape that includes edges that are positioned so that they do not contact a tubular with an edge; e.g., but not limited to, edges of a convex portion of a gripper.

In certain aspects, such a die is partially or totally loaded internally with a gripping grit (e.g. granular tungsten carbide) to provide multiple tiny contact points to facilitate gripping of a tubular and/or coated externally with such grit.

In certain aspects, such a die includes a metal backing to which the conformable gripper (e.g., but not limited to polyurethane) is bonded.

In certain aspects, an elastomeric gripper according to the present invention is pillow-shaped or "loaf" shaped, with a top that bulges outward (convex); or a top (a top that contacts a tubular or a top with a portion that contacts a tubular surface) that sags inward (concave); or a top convex in two directions and concave in two directions.

The present invention discloses methods for gripping a tubular, in one aspect to hold the tubular and in other aspects to facilitate rotation of the tubular, the method including: applying a gripping apparatus to a tubular having a tubular shape, the gripping apparatus being a conformable gripper; grippingly contacting the tubular with the conformable gripper, the conformable gripper having a gripper shape; and upon contact of the conformable gripper with the tubular, the gripper shape conforming to the tubular shape.

The present invention discloses grippers for gripping a tubular, in one aspect to facilitate rotation of the tubular, the gripper including: a body; the body having conformable material having an initial body shape; and the conformable material able to change the initial body shape upon contacting a tubular with the body, the tubular having a tubular shape, the conformable material able to conform to the tubular shape of the tubular to facilitate gripping of the tubular with the gripper.

Accordingly, the present invention includes features and advantages which are believed to enable it to advance oilfield tubular gripping technology. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain embodiments of the invention, there are other objects and purposes which will be readily apparent to one of skill in this art who has the benefit of this invention's teachings and disclosures. It is, therefore, an object of at least certain preferred embodiments of the present invention to provide:

New, useful, unique, efficient, non-obvious tubular grippers and methods of their use;

Such systems and methods which employ a gripping die with a conformable gripper;

Such systems and methods with an elastomeric gripper with a tubular contact area whose shape is conformable to the shape of a tubular being gripped;

Such dies with a convex top shape, "loaf" shape, a "pillow" shape, a shape concave on four sides or a shape with four concave portions, a shape convex on four sides or with four convex portions, or a shape with two concave sides, a shape with two concave portions and convex on two sides, or with two convex portions; and Tongs, tong jaws, slips, spiders, elevators, and wedge elements with conformable grippers or conformable die elements and methods of their use.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWING

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 3 is a perspective view of a gripping element according to the present invention.

FIG. 3A is an end view of a gripping element according to the present invention.

FIG. 3B is a side view of the gripping element of FIG. 3A.

FIG. 3C is a perspective view of the gripping element of FIG. 3A.

FIG. 4A is a perspective view of a gripping element according to the present invention.

FIG. 4B is an exploded view of the gripping element of FIG. 4A.

FIG. 4C is a side view of the gripping element of FIG. 4A.

FIG. 4D is an end view of the part of FIG. 4C.

FIG. 5A is a perspective view of a gripping element according to the present invention.

FIG. 5B is an exploded view of the gripping element of FIG. 5A.

FIG. 5C is a perspective view of a gripping element according to the present invention.

FIG. 5D is a top view of the gripping element of FIG. 5C.

FIG. 5E is an end view of the gripping element of FIG. 5C.

FIG. 6A is a perspective view of a gripping element according to the present invention.

FIG. 6B is a central lengthwise cross-section view of the gripping element of FIG. 6A.

FIG. 6C is a top view of the gripping element of FIG. 6A.

FIG. 6D is a central widthwise cross-section view of the gripping element of FIG. 6A.

FIG. 7A is a top view, cutaway, of a tong according to the present invention.

FIG. 7B is a perspective view of a jaw of the tong of FIG. 7A.

FIG. 7C is a top view of parts of the jaw of FIG. 7B.

FIG. 14 is a side cross-section view of a wedge support according to the present invention.

FIG. 15 is a side cross-section view of a slip apparatus according to the present invention.

FIG. 16 is a side cross-section view of a spider according to the present invention.

Figure 1:
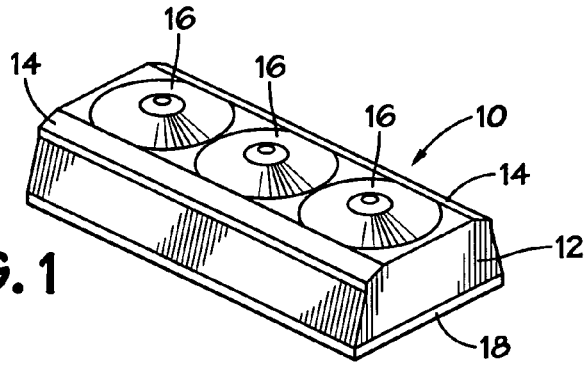
FIG. 1 is a perspective view of a gripping element according to the present invention.
Figure 1A:
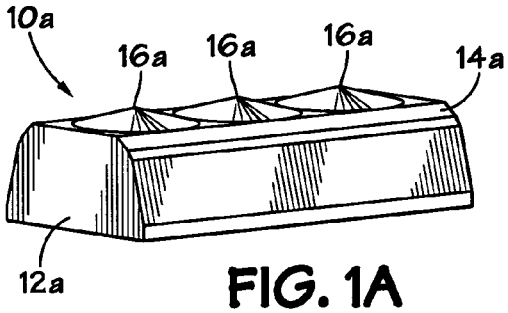
FIG. 1A is a perspective view of a gripping element according to the present invention.
Figure 1B:
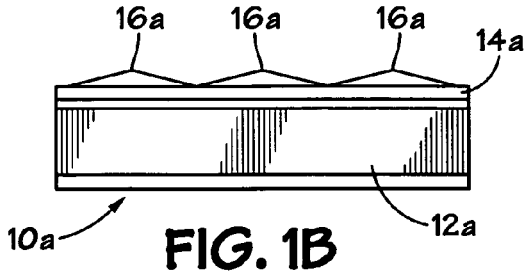
FIG. 1B is a side view of the gripping element of FIG. 1A.
Figure 1C:
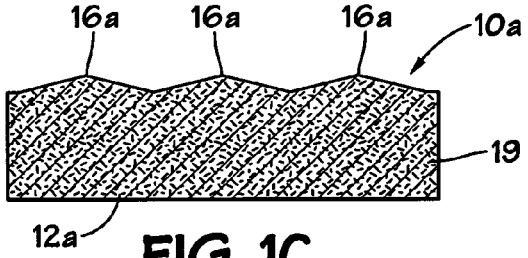
FIG. 1C is a central lengthwise cross-section view of the gripping element of FIG. 1A.

Presently preferred embodiments of the invention are shown in the above-identified figures and described in detail below. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein.

DETAILED DESCRIPTION OF THE INVENTION

FIG. 1 shows a gripper, gripping element or die 10 which has a body 12 (as any body of any embodiment according to the present invention) made from a conformable material, e.g. any elastomeric material (e.g. polyurethane or nitrile). The body 12 has two bevelled top edges 14 and a plurality of top projections 16 which, in one aspect, are generally conical. Optionally, the body 12 is bonded to a metal (e.g. steel, stainless steel, aluminum, or bronze) backing 18. Any die or gripper according to the present invention may have such a backing and/or one or more of the projections 16. Optionally, the bevelled edges 14 are deleted.

FIGS. 1A-1D show a die 10*a* (like the die 10) which has an optional metal backing 18*a* bonded to a body 12*a* with optional edges 14*a* and three top projections 16*a*. "Top" generally refers to the portion of a gripper which will initially contact a tubular; but any gripper according to the present invention and any part of any gripper can be used as a contact surface.

Figure 1D:
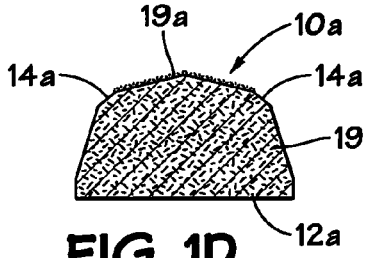
FIG. 1D is a central widthwise cross-section view of the gripping element of FIG. 1A.

Optionally, as is true of any die element and conformable gripper according to the present invention, the body 12*a* of the die element 10*a* may have dispersed therein an amount of small (e.g. largest dimension 2 mm) particles 19 of grit (e.g. silicon carbide, tungsten carbide or diamond) e.g., but not limited to, 36 grit silicon carbide, loaded 20% to 70% by weight, and, in one aspect, at about 50% by weight of the body 62. Optionally, as shown in FIG. 1D, and as may be true for any gripper herein, a coat 19*a* of gripping grit may be applied to a top surface. In certain aspects, the body 12*a* (and any gripper herein) is made of polyurethane with a hardness of 70 Shore D. It is within the scope of certain embodiments of the present invention to use polyurethane of a hardness of at least 40 Shore D and, in certain aspects, a polyurethane of a hardness no more than 80 Shore D.

It is within the scope of the present invention to load the body of a gripper with grit to at least 30% of the total weight and, in certain aspects, to a grit level of no more than 90% of the weight. It is within the scope of the present invention to load only the near-surface area of a gripper or only down to a certain level (e.g., in one particular aspect, down to 0.25 inches from the surface) instead of loading the entire volume. In one aspect the near-surface area has no grit. In one aspect a gripper is made of polyurethane with a hardness of 70 Shore D and is loaded with grit at 50% by weight.

Figure 2A:
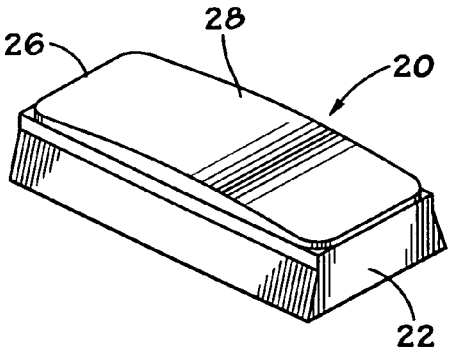
FIG. 2A is a perspective view of a gripping element according to the present invention.
Figure 2B:
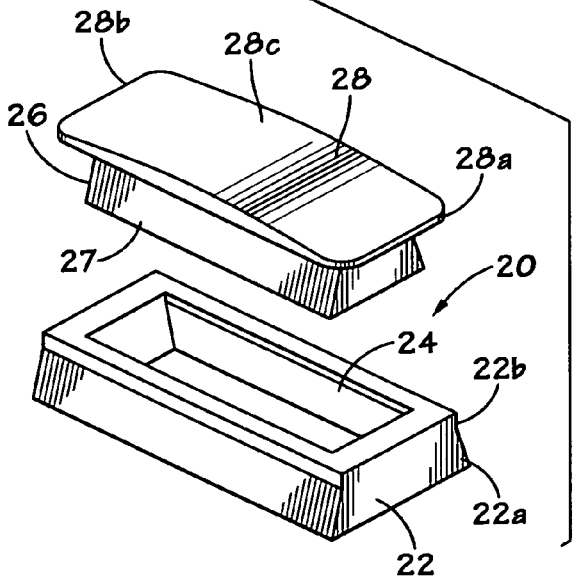
FIG. 2B is an exploded view of the gripping element of FIG. 2A.
Figure 6E:
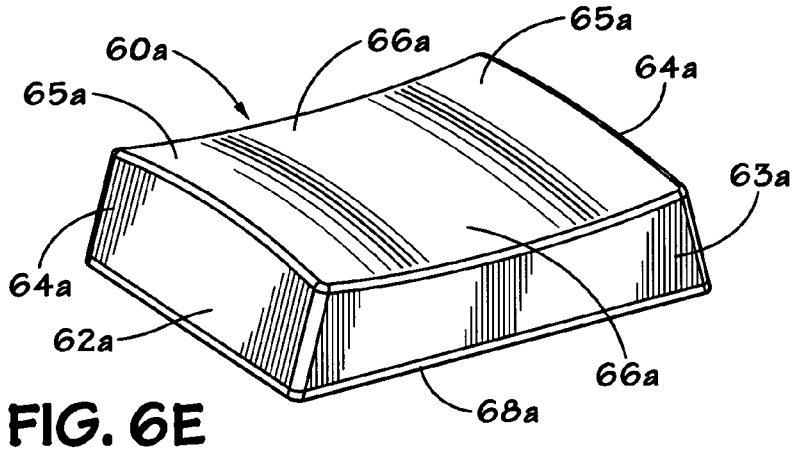
FIG. 6E is a perspective view of a gripping element according to the present invention.
Figure 6F:
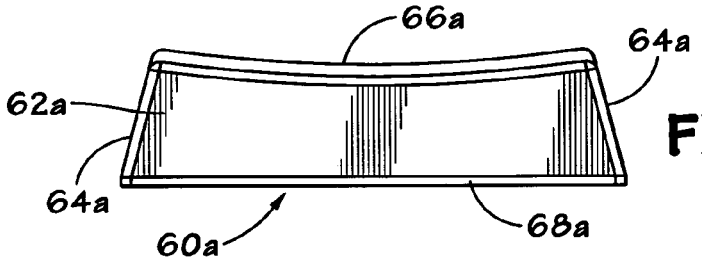
FIG. 6F is a side view of a gripping element of FIG. 6E.
Figure 6G:
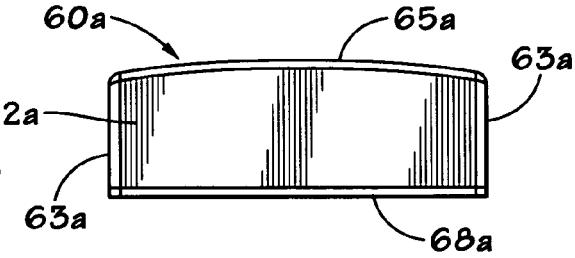
FIG. 6G is an end view of a gripping element of FIG. 6E.
Figure 6H:
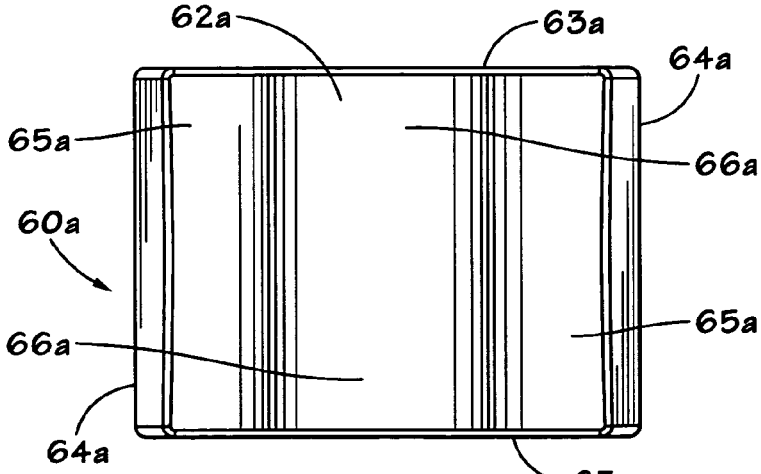
FIG. 6H is a top view of a gripping element of FIG. 6E.

FIGS. 2A and 2B show a die element 20 according to the present invention which has a body 22 with an inner recess 24. A conformable gripper 26 has a base 27 and a pillow-shaped top 28. The base 27 is sized and configured to be received in and held in the recess 24. Optionally, the top of the gripper 26 is flat, concave on all sides, or with two concave sides and two convex sides rather than pillow shaped.

The gripper 26 is held in the recess 24 with glue or adhesive, a friction fit and/or the gripper is cast together with the body 22. The pillow-shaped top 28 includes lower end edges 28*a*, 28*b* and a relatively higher top area 28*c*. A bottom 22*a* of the body 22 is wider—as viewed in FIG. 2A—than a top 22*b*.

FIG. 3 shows a conformable die element 30 according to the present invention made of conformable material which has a body 32 and bevelled edges 34. A conical projection 36 is located at the center of a top 38 of the body 32. A bottom 32*a* of the body 32 is wider—as viewed in FIG. 3—than a top 32*b*.

FIGS. 3A-3C show a die element 30*a* (like the die element 30) which has a body 32*a* with optional bevelled edges 34*a* and a top projection 36*a*. As shown in FIG. 3A the body 32*a* has a trapezoidal shape.

FIGS. 4A and 4B show a conformable die element 40 according to the present invention with a body 42 having a recess 44 which receives and holds a conformable gripper 46. A bottom 42*a* of the body 42 is wider—as viewed in FIG. 4A—than a top 42*b*.

The gripper 46 has a raised upper surface 47 with a high point at 48. The conformable gripper 46 is received and held in the recess 44 with a friction fit and/or with an adhesive.

FIGS. 5A and 5B show a die element 50 with a body 52 having dovetail recesses 54 in an upper part 52*b*. The upper part 52*b* is narrower than a lower part 52*a* of the body 52 as viewed in FIG. 5A. Correspondingly shaped dovetail projections 57 of a conformable gripper 56 are received and held in the recesses 54. Any gripper in any embodiment according to the present invention can be attached to a body this way. An adhesive may be used to facilitate holding of the projections 57 in the recesses 54 and/or they can be cast together with an activator. Optionally the body 52 is used a gripper itself. Optionally, the gripper 56 is used with the side with the projections 57 as the contact area for contacting a tubular.

The gripper 56 has a concave top surface 58 (concave on two ends) but, optionally, it can have a top surface like any of the die elements disclosed herein (e.g., but not limited to, those of FIGS. 1, 2A, 3, 4A and 6A).

FIGS. 5C-5E show a gripper 50*a* with a body 52*a*, a curved top surface 53*a*, and a plurality of projections 54*a* projecting out from the body 52*a*. Optionally (as described in more detail below) the body 52*a* may be coated with gripping grit and/or have gripping grit dispersed therein (and this is true for any gripper according to the present invention). Optionally, any part of projection of a gripper according to the present invention can be coated with gripping grit, made substantially from gripping grit or have gripping grit dispersed therein, e.g. like the grit 57*a* shown in FIG. 5E (as may be true for any part or projection of any gripper according to the present invention).

FIGS. 6A-6D show a conformable die element 60 according to the present invention which has a body 62 made of conformable material. The body 62 has a top 66 with convexly-curved shape. In both length and width, the middle of the body 62 is higher than the ends (or sides). Optionally, a die element according to the present invention (any disclosed herein) is convex only in length or only in width and either flat on two sides or concave on two sides (e.g. convex in length and concave in width, or vice-versa).

Optionally, the body 62 is bonded to a backing 68.

FIGS. 6E-6H show a conformable die element 60*a* with a body 62*a*, sides 63*a*, ends 64*a*, top convex portions 65*a*, top concave portions 66*a*, and an optional backing 68*a*. The conformable die element 60*a* is made of conformable material.

The sides 63*a* and the ends 64*b* are sloped slightly inwardly (e.g., as may be true for any side of any die element according to the present invention, at an angle between 10 degrees and 45 degrees and, in one particular aspect, at about 15 degrees).

A body made of polyurethane or urethane body (e.g. any body of any embodiment herein, e.g. a body 12, 22, 42, or 52) may be of the same hardness as that of the grippers (e.g. grippers 26, 46, 56).

FIGS. 7A and 7B show a power tong 70 according to the present invention (which is similar to power tongs disclosed in U.S. Pat. No. 5,291,808 but which has grippers according to the present invention). The tong 70 has a housing 71, a rotary 72 driven by a drive mechanism with a motor M (shown schematically) and rollers r, and jaws 74 which close upon and grip oil field tubular member T. Each jaw 74 has a gripper element 76 according to the present invention. Each gripper element 76 has a generally concave shaped removable conformable die 79 held in place by a retaining screw 76*a*. Each die 79 has a conformable body 78 and, optionally, has a series of projections held in recesses 76*b*. Each die body 78 is made of conformable material, e.g. elastomeric material (any disclosed herein for any die element or gripper according to the present invention).

It is within the scope of the present invention for any die of any tong jaw to have a conformable gripper according to the present invention.

Figure 8A:
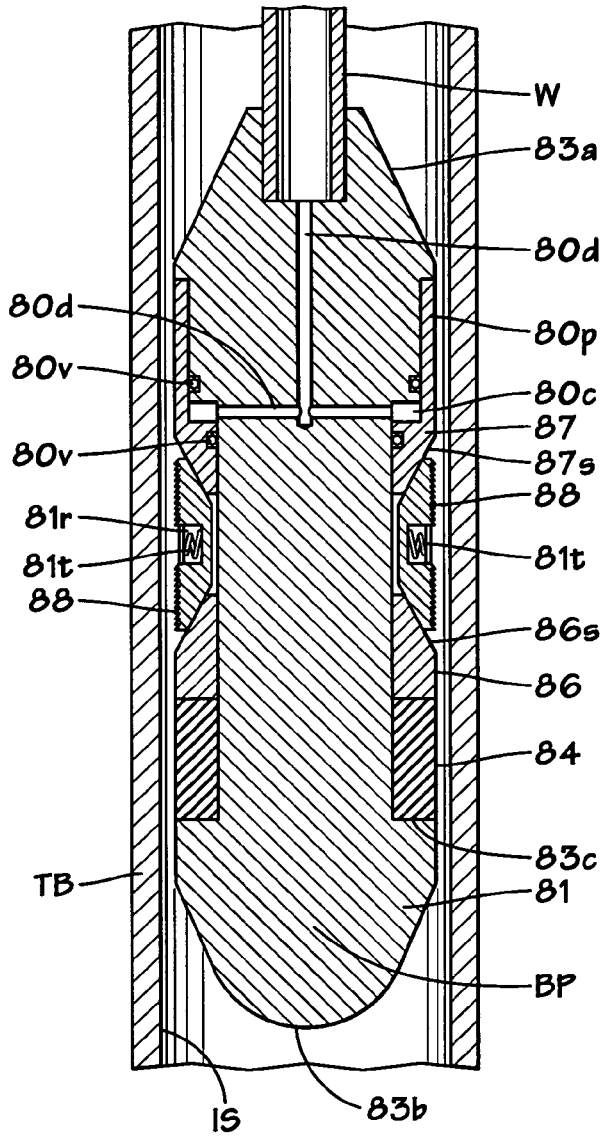
FIG. 8A is a cross-section view of a bridge plug apparatus according to the present invention.
Figure 8B:
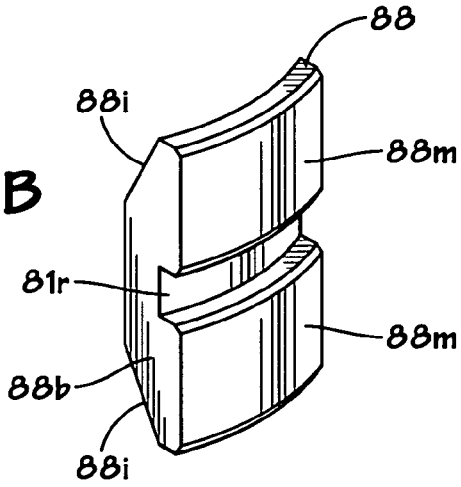
FIG. 8B is a perspective view of a slip of the apparatus of FIG. 8A.

FIG. 8A illustrates gripper elements according to the present invention used in conjunction with a bridge plug BP which is designed to be inserted into casing or tubing such as tubular TB and then activated in order to block the flow of fluid through tubular. The bridge plug BP has a plug body 81 with an upper section 83*a* and a lower section 83*b*. The upper section attaches to a work string W which allows the bridge plug PB to be lowered down a well bore and to be positioned at the desired depth of placement. Lower section 83*b* forms a head portion with shoulders 83*c* against which a rubber packing element 84 rests. Positioned above the packing element 84 is a lower expansion cone 86 and above the cone 86 is an upper expansion cone 87. Both the upper and lower expansion cones have inclined surfaces 86*s* and 87*s*, respectively. It is to be understood that both the expansion cones and the packing element are annular shaped and extend continuously around the plug body as a single element.

Positioned between the expansion cones are a series of slips 88. Each slip 88 is an arcuate segment positioned around the plug body 81. An opposing pair of such arcuate segments is seen in the slips 88. In the bridge plug there are six slips 88, but alternate embodiments could employ fewer or more slips 88. Each slip 88 has a body 88*b* with inclined surfaces 88*i* at each end of the body 81. The body 81 has an outer surface 81*o* and a slip ring channel 81*r*. Slip retaining rings 88*r* rest in a ring channel 81*r* and encircle the plurality of slips 88. A slip spring 81*t* is positioned between slip retaining ring 88*r* and each ring channel 81*r* biases the slips 88 away from the inner surface of the tubular TB. The inclined surfaces of the slips 88 correspond to and travel along inclined surfaces 86*s* and 87*s* of the upper and lower cones. Each slip 88 has a conformable member 88*m* covering the outer surface of the slips which can engage the inner surface IS of the tubular TB. The member 88*m* may be like any die or gripper disclosed herein according to the present invention.

A setting piston 80*p* is formed by an arcuate element extending continuously around plug body 81 and, in one aspect, is formed integrally on the upper cone section 87. A variable volume fluid cavity 80*c* is formed between the setting piston 80 and the plug body 81 which communicates with fluid channel 80*d* which runs through upper section of the plug body 81 and allows fluid to be transmitted from the work string, through plug body 81 to the fluid cavity 80*c*. Conventional seals such a O-rings 80*v* form a fluid tight seal between the setting piston and the plug body 81.

In operation, the bridge plug 80 is positioned on a work string and lowered down the wellbore to the depth at which it is desired to plug the tubing or casing. While the bridge plug is being lowered down the wellbore, it is in an unactivated position (FIG. 8A). After the bridge plug is lowered to the desired depth, it is activated by pumping pressurized fluid through the work string into the channel 80*d* to the fluid cavity 80*c* which then moves the setting piston 80*p* downward forcing the upper expansion cone 87 downward causing incline surfaces on the upper and lower expansion cones to slide along the inclined surfaces 88*i* of slips 88. This movement forces the lower expansion cone 86 against the rubber packing element 84, causing it to expand against the inner surface of the tubular TB and thereby sealing or plugging the tubular. Simultaneously, the movement of inclined surfaces of the upper and lower expansion cones 86 and 87 along inclined surfaces 88*i* of slips 88 causes the slips 88 to overcome the tension in the slip spring 88*t* and move toward and eventually engage the inner surface of the tubular TB.

It is within the scope of the present invention to use slips 88 of conformable material with devices similar to bridge plugs, such as packers used for production, isolation, testing and stimulation. Packers are structurally similar to bridge plugs except that packers contain one or more internal passages to allow a regulated flow of fluid through the packer or to accommodate instrument wires or control lines which must pass through the packer. Those skilled in the art will recognize that there are also bridge plugs and packers that are activated by means other than the hydraulic mechanism described above. The slips according to the present invention are equally suitable for use in bridge plugs or packers which are activated by mechanical means, wirelines, electric wirelines or other conventional methods used to operate the downhole tools typically found in the drilling industry. A bridge plug not according to the present invention is disclosed in U.S. Pat. No. 7,036,397, FIG. 4.

Figure 9:
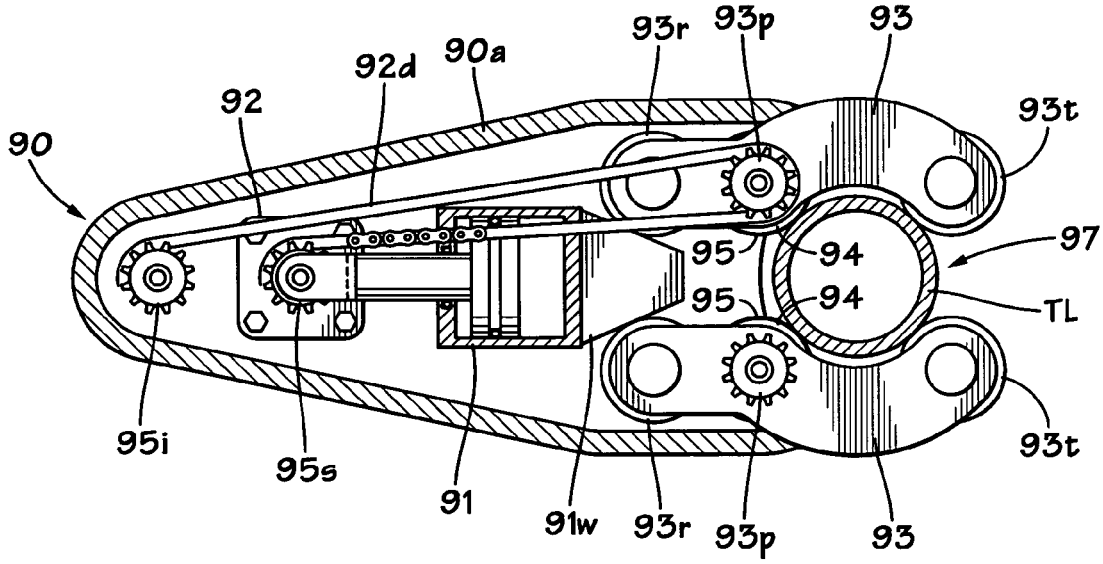
FIG. 9 is a top view cutaway, of a spinner according to the present invention.

A pipe spinner 90 according to the present invention is shown in FIG. 9 which is like the pipe spinner shown in FIG. 14 of U.S. Pat. No. 7,036,397 (a spinner without the benefit of the present invention). The pipe spinner 90 has a spinner body 91 and two pinch roller arms 93 which form the throat 97. The pinch roller arms 93 are pivotally mounted by pivot shafts 93*p*. Rear rollers 93*r* are mounted on the rear ends of the arms 93 and pinch rollers 93*t* are mounted on the front ends. Mounted between the rear rollers 93*r* and the pinch rollers 93*t* are drive rollers 95 which rotate on the pivot shafts 93*p*. The spinner body 91 contains a motor 92 which supplies torque to a motor sprocket 92*s*. A drive chain 92*d* (only half of which is shown) interconnects the drive rollers 95, the motor sprocket 92*s*, and any idler sprocket 95*i* so that torque may be transferred from the motor 92 to the drive rollers 95. The pinch rollers (and thus throat 97) are opened and closed on a tubular TL by operation of a roller wedge 90*w* which in turn is connected to an hydraulic cylinder 91.

The pipe spinner 90 has a conformable gripper 94 according to the present invention on each drive roller 95. This gripper is either pure conformable material, e.g. elastomer or conformable material, e.g. elastomer, with grit therein (any grit described above and at any volume level and at any location in the gripper as described above).

Any drive roller of any spinner or tong may, according to the present invention, have a gripper according to the present invention.

Figure 10:
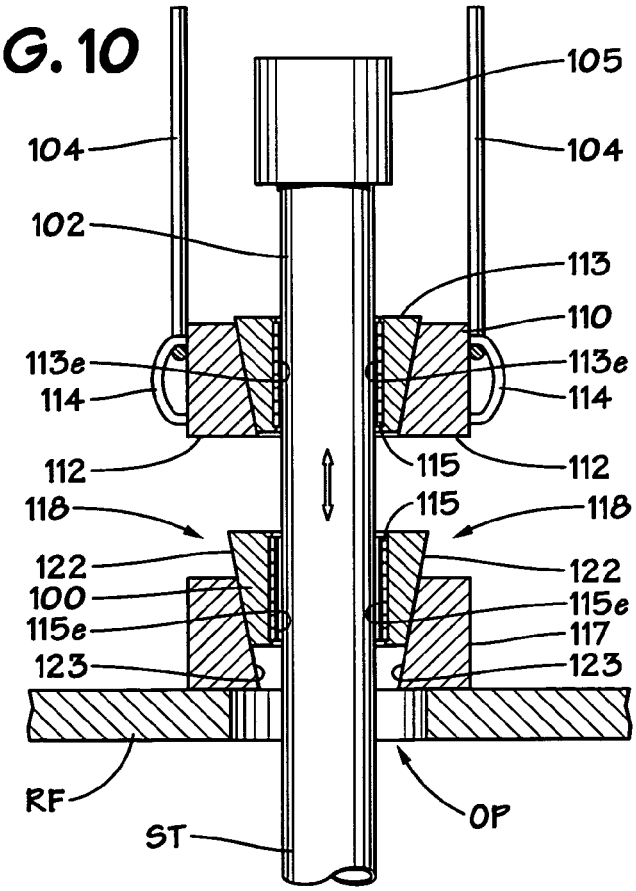
FIG. 10 is a side cross-section view of an elevator according to the present invention and a rig slip system according to the present invention.

FIG. 10 shows a slip system 100 according to the present invention and an elevator 110 according to the present invention for use in a drilling rig structure (not shown) other than a rig floor RF which has an opening OP through which a string of tubulars ST extends into a wellbore below the rig structure. A tubular 102 being gripper by the slip system 100 is shown, but the string ST includes a plurality of tubulars. During the normal operations of inserting or removing tubulars from a wellbore, it is necessary to grip a tubular like the tubulars 102 in order to lift or lower it and the attached drill string. The slip system 100 includes a slip bowl 117, slip assemblies 118, elevator bowl 112, elevator slip assemblies 113, and slip die inserts 115. The slip bowl 117 has an annular configuration which encircles the circumference of the tubular 102. The slip bowl 117 can be formed of two semi-circular rings placed around the tubular 102 rather than having to position a unitary ring over an end of the tubular. The slip bowl 117 is secured to the rig floor RF. The tubular 102, as shown in FIG. 10, may freely move in the slip bowl.

The downward movement of the tubular 102 is stopped when the slip assemblies 118 are inserted in a space between slip bowl 117 and tubular 102. While only two slip assemblies 118 are shown, it will be understood that additional slip assemblies could be spaced around the entire perimeter of the tubular 102. In one aspect, the slip assemblies 118 are generally wedge shaped with a first inclined surface 122 which is designed to have an angle which is the supplement of the angle of a second inclined surface 123 formed on the slip bowl 117. The slip assemblies 118 have conformable dies 115 according to the present invention.

An elevator bowl 112 of the elevator 110 includes elevator slip assemblies 113. The elevator bowl 112 slip assemblies are identical to the slip assemblies 118, but the elevator bowl 112 is not fixed to the rig floor RF. The elevator bowl 112 has brackets 114 or similar devices which allow the elevator bowl 112 to be lifted. Lifting bails 104 engage the brackets 114. The lifting bails 104 are in turn attached to drawworks or another lifting mechanism (not shown) used on the drilling rig.

The slip assemblies 113 and 118 include dies 113*d* and 118*d* each with a conformable gripper 113*e* and 118*e*, respectively These grippers may be made of any conformable material and may be any die or gripper disclosed herein.

In raising and lowering the tubular 102, the slip assemblies 118 and elevator slip assemblies 113 are used in an alternating grip and release sequence. When it is desired to raise tubular 102, the slip bowl 117 is positioned around the tubular 102 and the slip assemblies 118 are positioned to grip tubular 102. The drilling machinery or the like which is suspending the tubular 102 and its attached drill string is relaxed. When the tubular 102 is allowed to move downward, the slip assemblies 118 firmly grip the tubular 102. The elevator bowl 112 is then positioned around the tubular 102 and the elevator slip assemblies 113 are positioned between the tubular 102 and the elevator bowl 112. When the lifting bails 104 apply a lifting force to the elevator bowl 112, the elevator slip assemblies 113 are securely wedged against and grip the tubular 102. As the lifting force on the elevator bowl 112 continues and raises the tubular 102, the slip assemblies 118 slide upward and cease to grip the tubular 102, releasing the slip assemblies 118 and allowing workers to manually remove the slip assemblies 118 from the slip bowl 117 or, where a hydraulic system is employed, allowing the hydraulic cylinder assemblies to raise the slip assemblies 118 high enough along the inclined surface 123 to prevent interference between the slip assemblies 118 and the rising tubular 102. Typically, the elevator bowl 112 lifts the tubular 102 to a desired height such as the next tubular connecting joint in the drill string being above the slip bowl 117. The slip assemblies 118 are then inserted into the slip bowl 117 and set. Thereafter, the lifting force on the elevator bowl 112 is slowly released so that the tubular 102 is allowed to begin downward movement. The downward movement of tubular 102 is quickly arrested as the slip assemblies once again place a large radial load on the tubular 102. At this point, the tubular 102 can be broken out and set aside before the elevator bowl 112 is then lowered to a position just above slip assemblies 118 in preparation for another lift sequence. The process is repeated until the desired length of drill string has been raised above the level of the rig floor RF.

Typically, slips and elevators described above are used in conjunction with tubulars which have a coupling or upset connection 105 (FIG. 10). If for any reason the slip dies of the slip assemblies 118 or elevator slip assemblies 113 fail to grip the tubular 102 and the tubular 102 begins to slide through the elevator, the slip assembly 100 stops its downward descent.

Figure 11:
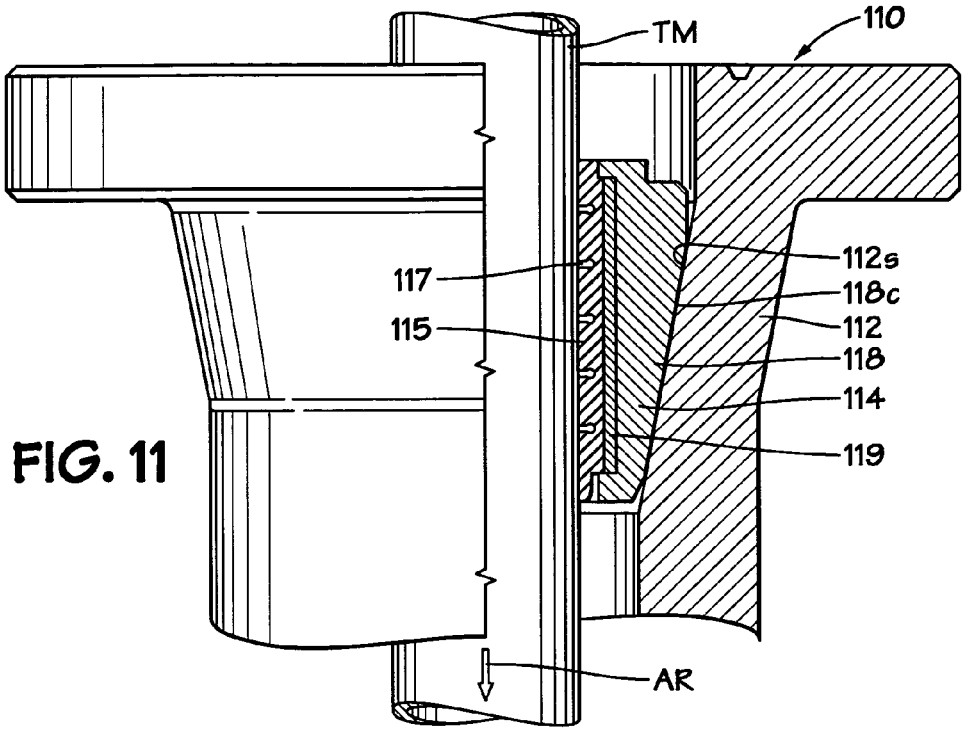
FIG. 11 is a side view, partially in cross-section, of a wedge support according to the present invention.

FIG. 11 shows a wedge support 110 according to the present invention which has a body 112 with an annular converging seat 112*s* for supporting a tubular member TM (e.g. pipe, casing, or tubing). A plurality of wedge segments 114 (or "slip" apparatuses) are spaced apart around the seat 112*s*.

Each wedge segment 114 has a conformable gripper 115 according to the present invention optionally with a backing 119. The gripper 115 is connected to the body 118 and, if present, the backing 119 is connected to the body 118. The body 118 has a converging surface 118*c* corresponding to the surface of the seal 112*s*. A downward load on the tubular member TM indicated by the arrow AR causes a wedging engagement of the surface 118*c* against the seat 112*s*, compressing the gripper 115 against the tubular member TM.

Optionally, the gripper 115 (as may be true of any gripper herein) has one or a plurality (a plurality is shown in FIG. 11) of recesses 117 which can facilitate conforming of the gripper 115 to the exterior surface of the tubular member TM.

Figure 12:
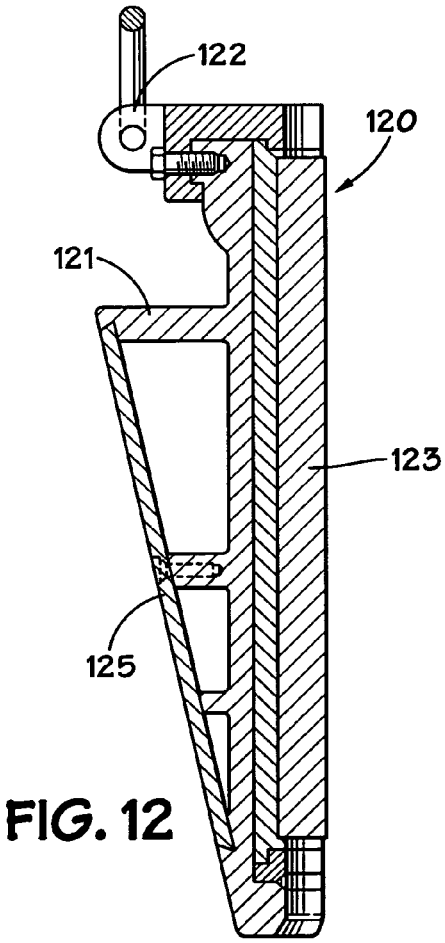
FIG. 12 is a side view in cross-section of a slip apparatus according to the present invention.

FIG. 12 shows a slip apparatus 120 according to the present invention with a body 121, a handle 122, and an insertable-removable conformable gripper 123 according to the present invention. The gripper 123 may be any conformable gripper according to the present invention, with or without internal gripping grit. The body 121 has an inclined surface 125 for wedging engagement with a support body (e.g. like the surface 118*c*, FIG. 11).

Figure 13A:
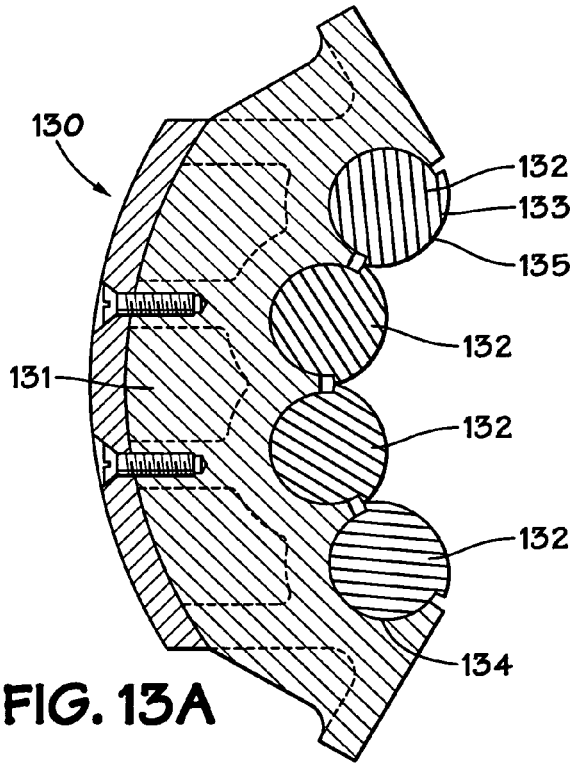
FIG. 13A is a top view of a slip apparatus according to the present invention.
Figure 13B:
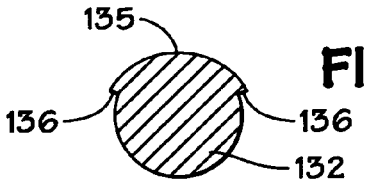
FIG. 13B is a top view of a die of the apparatus of FIG. 13A.

FIG. 13A shows a slip apparatus 130 according to the present invention with a body 131 like the slip apparatus of FIG. 12; but with a plurality of spaced-apart conformable grippers 132 according to the present invention. Each gripper 132 has a body 133 held in a corresponding recess 134 of the body 131. Each gripper 132 has a front section 135 which projects beyond the body 133 and which has two angled edges 136.

As shown, the front sections 135 contact each other; but it is within the scope of the present invention for the front sections 135 to be spaced-apart.

FIG. 14 shows a slip apparatus 140 according to the present invention for use in a support SP (like the wedge support of FIG. 11). The apparatus 140 has a body 141 with a seat surface 142 for wedging engagement with a corresponding seat 143 of the support SP.

A conformable gripper 146 according to the present invention for gripping a tubular TL has an optional backing 147 and is held in a corresponding recess 148 of a body 141. Rear edges 144*a*, 144*b* of the gripper 146 are spaced apart from the body 141. The gripper 146 has a plurality of segments 145 which contact each other along lines 145*l*. A plurality of holes 145*h* extend through the gripper 145. These holes 145*h* serve to define a portion of each segment 145. Any gripper according to the present invention may have one or more holes 145*h*.

FIG. 15 shows a slip apparatus 150 (or wedge element) with a body 151 having a recess 152 for holding a conformable gripper 154 according to the present invention. The gripper 154 made of conformable material includes a plurality of spaced-apart projections 156 and, optionally, a backing 158. Each projection 156 has a curved front surface 159.

FIG. 16 shows a spider 160 according to the present invention. A pipe PP is gripped by slips 162. Each slip 162 has a body 163 and a conformable gripper 166 according to the present invention connected (in one aspect, adhered) to the body 163. The grippers 166 can be any gripper disclosed herein. The spider 160 has a body 161 with an annular converging seat 167 and each slip 162 has a seat surface 168 corresponding to the seal 167.

Figure 17C:
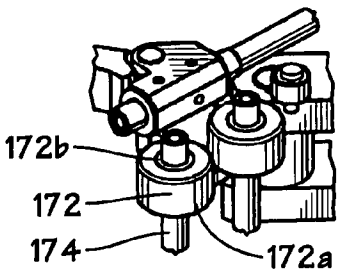
FIG. 17C is an enlarged view of a portion of the apparatus of FIG. 17A.
Figure 17B:
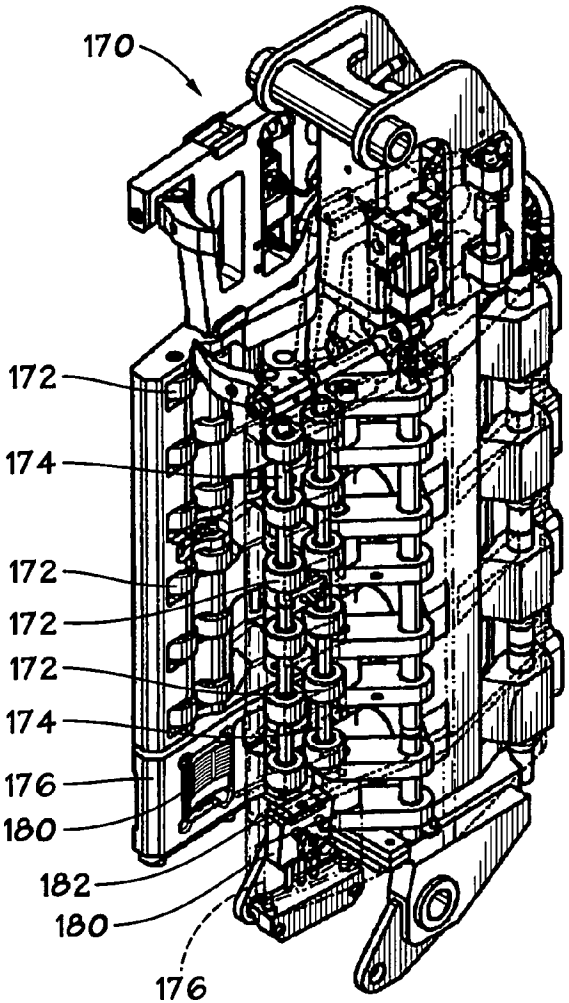
FIG. 17B is a perspective view of the apparatus of FIG. 17A with some outer parts removed.
Figure 17A:
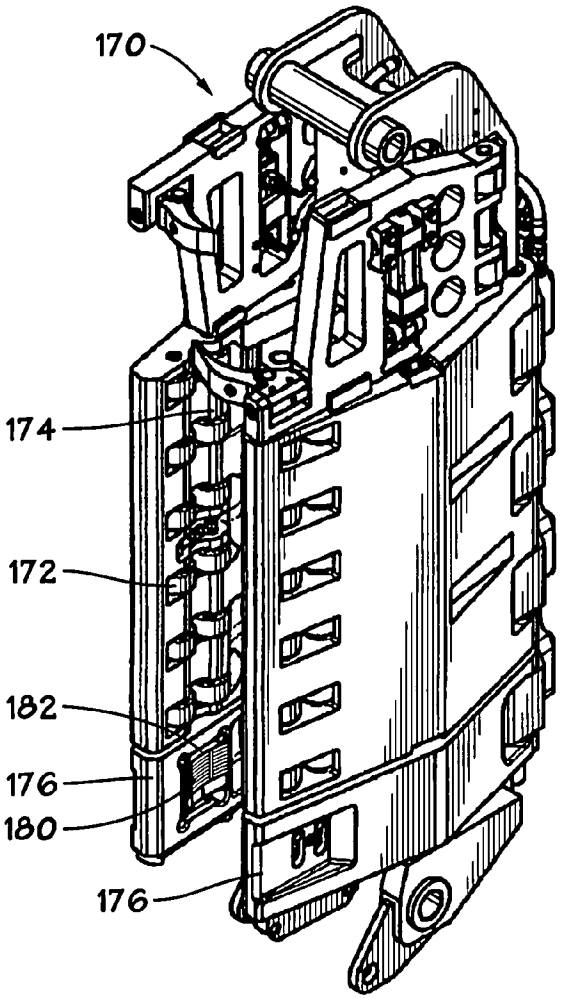
FIG. 17A is a perspective view of a hoisting jaw apparatus according to the present invention with die elements according to the present invention.

FIGS. 17A-17C illustrate a hoisting jaw apparatus 170 according to the present invention, e.g., but not limited to, a hoisting jaw apparatus for a racking system. In one operation a racker stabs a threaded pipe, detects set-down, and the hoisting jaw apparatus 170 (with conformable dies 180 according to the present invention) opens. The racker exerts a constant upward force during spin-in, through rollers 172 made of conformable material (e.g. as the material of any die element disclosed herein), to limit the weight of the pipe put onto the threads. As the pipe is spun (e.g. by a spinner or spinning wrench), the rollers 172 spin about the pipe while continuing to support the weight of the pipe vertically.

During spin-out, a similar operation is involved, except the racker pulls up with a constant upward force slightly higher than the weight of the pipe, thereby allowing the pipe to be lifted as the threads advance, ending with a small "stand jump" to clear the threads and keep them from bumping. The rollers 172 are passive rollers which are loaded parallel to the axis of roller pins 174, rather than tangentially as in certain powered rollers.

Each die 180 is releasably connected to a die holder 182 which is releasably connected to a side plate 176. The pins 174 pass through a hole 172*b* in a body 172*a* of each roller to rotatably mount the rollers 172 to a body 178 of the hoisting jaw 170.

The present invention, therefore, provides in some, but not in necessarily all, embodiments methods for gripping a tubular, in one aspect to facilitate rotation of the tubular, the method including: applying a gripping apparatus to a tubular having a tubular shape, the gripping apparatus comprising a conformable gripper; grippingly contacting the tubular with the conformable gripper, the conformable gripper having a gripper shape; and upon contact of the conformable gripper with the tubular, the gripper shape conforming to the tubular shape. Such methods may have one or some, in any possible combination, of the following: wherein the top of the conformable gripper has edges, the method further including contacting the tubular with the conformable gripper so that the edges of the top do not contact the tubular; wherein the gripper apparatus is one of a tong apparatus, a bridge plug, a hoisting jaw, a packer, a pipe spinner, and an elevator; wherein the conformable gripper has a top with a top shape which is initially one of a concave shape and a convex shape; wherein the conformable gripper has gripping grit therein; and/or wherein the conformable gripper has a body made of conformable material and a metal backing bonded to the body.

The present invention, therefore, provides in some, but not in necessarily all, embodiments a gripper for gripping a tubular, in one aspect to facilitate rotation of the tubular, the gripper including: a body; the body having conformable material having an initial body shape; and the conformable material able to change the initial body shape upon contacting a tubular with the body, the tubular having a tubular shape, the conformable material able to conform to the tubular shape of the tubular to facilitate gripping of the tubular with the gripper; wherein the conformable gripper initial body shape includes a top with a shape which is one of a concave shape, a convex shape, and a pillow shape; the initial body shape including a top with a concave portion and a convex portion; wherein the initial body shape has a generally rectangular base and a convex top; wherein the initial body shape has a generally rectangular base and a convex top; the initial body shape is generally rectangular with a top with two spaced-apart end portions and two spaced-apart side portions, each of the two spaced-apart end portions is convex, and each of the two spaced-apart side portions is concave; the initial body shape has a generally rectangular base, a top, and at least one projection projecting from the top; the body including an amount of gripping grit; the gripping grit is dispersed throughout the body; the gripping grit is within 0.25 inches of a top of the body; the gripping grit is present by weight as about 50% of the weight of the body; the gripping grit is coated on a top of the body; the body having a plurality of spaced-apart projections projecting from the body for contacting a tubular; wherein the projections are made of conformable material; wherein the projections include gripping grit dispersed in the conformable material; wherein the body is made of polyurethane with a hardness of at least 40 Shore D; and/or wherein the body is about 50% by weight gripping grit and about 50% by weight polyurethane with a hardness of 70 Shore D.

The present invention, therefore, provides in some, but not in necessarily all, embodiments a gripper for gripping a tubular, the gripper including: a body; the body having conformable material having an initial body shape; and the conformable material able to change the initial body shape upon contacting a tubular with the body, the tubular having a tubular shape, the conformable material able to conform to the tubular shape of the tubular upon contact of the tubular with the gripper.

The present invention, therefore, provides in some, but not in necessarily all, embodiments an apparatus for gripping a tubular to facilitate rotation of the tubular, the apparatus including: a housing; gripping apparatus movably connected to the housing; the gripping apparatus including a plurality of spaced-apart conformable grippers; and movement apparatus for moving the plurality of spaced-apart conformable grippers into gripping contact with a tubular to be rotated. Such an apparatus, in certain aspects, is one of a wrench, a tong, and a pipe spinner.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. What follows are some of the claims for some of the embodiments and aspects of the present invention, but these claims are not necessarily meant to be a complete listing of nor exhaustive of every possible aspect and embodiment of the invention. It is the express intention of the applicant not to invoke 35 U.S.C. § 112, paragraph 6 for any limitations of any of the claims herein, except for those in which the claim expressly uses the words 'means for' together with an associated function. In this patent document, the word "comprising" is used in its non-limiting sense to mean that items following the word are including, but items not specifically mentioned are not excluded. A reference to an element by the indefinite article "a" does not exclude the possibility that more than one of the element is present, unless the context clearly requires that there be one and only one of the elements.

What is claimed is:

1. A method for gripping a tubular to facilitate rotation of the tubular, the method comprising applying a gripping apparatus to a tubular having a tubular shape, the gripping apparatus comprising a conformable gripper, the conformable gripper for gripping the tubular to facilitate rotation of the tubular, the conformable gripper comprising a body, the body having conformable material having an initial body shape, and the conformable material able to change the initial body shape upon contacting a tubular with the body, the conformable material able to conform to the tubular shape of the tubular to facilitate gripping of the tubular with the gripper, and the initial body shape generally rectangular with a top with two spaced-apart end portions and two spaced-apart side portions, each of the two spaced-apart end portions is convex, and each of the two spaced-apart side portions is concave, grippingly contacting the tubular with the conformable gripper, and upon contact of the conformable gripper with the tubular, the conformable material conforming to the tubular shape.

2. The method of claim 1 wherein the top of the conformable gripper has edges, the method further comprising contacting the tubular with the conformable gripper so that the edges of the top do not contact the tubular.

3. The method of claim 1 wherein the gripper apparatus is one of a tong apparatus, a bridge plug, a hoisting jaw, a packer, a pipe spinner, and an elevator.

4. The method of claim 1 wherein the conformable gripper has a top with a top shape which is initially one of a concave shape and a convex shape.

5. The method of claim 1 wherein the conformable gripper has gripping grit therein.

6. The method of claim 1 wherein the conformable gripper has a body made of conformable material and a metal backing bonded to the body.

7. An apparatus for gripping a tubular to facilitate rotation of the tubular, the apparatus comprising a housing, gripping apparatus movably connected to the housing, the gripping apparatus including a plurality of spaced-apart conformable grippers, movement apparatus for moving the plurality of spaced-apart conformable grippers into gripping contact with a tubular to be rotated, each of the spaced-apart conformable grippers for gripping the tubular to facilitate rotation of the tubular, each of the spaced-apart conformable grippers comprising a body, the body having conformable material having an initial body shape, the conformable material able to change the initial body shape upon contacting a tubular with the body, the tubular having a tubular shape, the conformable material able to conform to the tubular shape of the tubular to facilitate gripping of the tubular with the gripper, the initial body shape is generally rectangular with a top with two spaced-apart end portions and two spaced-apart side portions, each of the two spaced-apart end portions is convex, and each of the two spaced-apart side portions is concave.

8. The apparatus of claim 7 wherein the apparatus is one of a wrench, a tong, and a pipe spinner.

* * * * *